United States Patent [19]

Roccaforte

[11] 4,126,266

[45] Nov. 21, 1978

[54] SELF ERECTING SOAP SCOOP AND BLANK FOR SAME

[75] Inventor: Harry I. Roccaforte, Western Springs, Ill.

[73] Assignee: Champion International Corporation, Stamford, Conn.

[21] Appl. No.: 857,097

[22] Filed: Dec. 5, 1977

[51] Int. Cl.[2] ..... B65D 5/10

[52] U.S. Cl. ..... 229/39 R; 206/806; 206/627; 229/41 B

[58] Field of Search ..... 229/39 R, 41 B, 41 R; 206/806, 627

[56] References Cited

U.S. PATENT DOCUMENTS

| | | | |
|---|---|---|---|
| 1,163,615 | 12/1915 | Cooley | 206/806 X |
| 2,384,559 | 9/1945 | Powell | 229/39 R |
| 2,678,766 | 5/1954 | Levkoff | 229/41 B X |
| 2,702,154 | 2/1955 | Linson | 229/39 R |
| 2,990,099 | 6/1961 | Ryder | 229/39 R |
| 3,107,936 | 10/1963 | Parsons | 294/55 |
| 3,167,240 | 1/1965 | Collyrs et al. | 206/627 X |
| 4,017,015 | 4/1977 | Jefferson | 229/39 R X |

*Primary Examiner*—Davis T. Moorhead
*Attorney, Agent, or Firm*—Evelyn M. Sommer

[57] ABSTRACT

A blank for forming a self-erecting soap scoop includes a front panel, a back panel, a glue flap and a pair of side panels which are hingedly connected to each other to form the upstanding walls of the soap scoop. The blank further includes a plurality of closure flaps and pull down flaps hingedly connected to the wall forming panels for forming an automatically flattened base portion. Each of a pair of opposed closure flaps includes an elongated locking tab having a camming surface which terminates in a locking notch. In addition, each of the respective panels which is connected to a tab bearing closure flap includes a locking tab receiving slot. When the soap scoop is erected the locking tabs emanate from opposed upstanding panels and the tab receiving slots are diagonally opposed to one another. When the scoop is squared and the base flattened, the camming surfaces of the opposed locking tabs engage each other until the locking notch of each engages. At this point the tabs are automatically aligned with their respective tab receiving slots on the opposite side wall and locked therein.

4 Claims, 6 Drawing Figures

SELF ERECTING SOAP SCOOP AND BLANK FOR SAME

BACKGROUND OF THE INVENTION

The subject invention relates to self-erecting containers and more particularly to self-erecting containers that are used as soap scoops or measuring cups. A well known practice of manufacturers of powdered laundry detergents is to include within the boxes of detergent self-erecting soap scoops which have indicia on them so that the scoops may be used as measuring cups. The scoops are included with the detergent as a convenience to the consumer so that the manufacturer's recommended amount of laundry detergent for a particular wash load may be easily and conveniently measured. The scoops take the form of tubular containers each having four upstanding panels including two opposed side walls and a front and back panel. The first panel is generally longer than the back panel and has a rounded top edge to facilitate the scooping of the detergent. The bottom portion or base of the container is generally rectangular in configuration and is formed from a plurality of closure flaps which are hingedly connected to the upstanding panels. More particularly, the base is generally formed from a pair of major closure flaps each of which is hingedly connected to a side panel, and a pair of minor closure flaps which are hingedly connected to the front and back panels. In addition the base includes a pair of pull down flaps each of which is hingedly connected to a minor closure flap, and adhered to a major closure flap so as to connect a major and minor closure flap. One of the major closure flaps conforms in configuration to that of the desired base, i.e., it extends from the side wall to which it is connected to the opposing side wall. This closure flap typically includes a pair of lock tabs which, when the scoop is erected, are aligned with and are received by a pair of slots in the opposed side wall. The other major closure flap typically has half the plan area of the scoop base.

It will be appreciated that it would be impractical for the soap scoop to be packed in detergent boxes in a fully erected state. Accordingly, the scoops are packaged in a flattened condition with the bottom closure flaps being folded up within the scoop and the lock tabs unsecured. In order to erect the scoop, the scoop is squared thus causing the pull down flaps to flatten. As the pull down flaps flatten they simultaneously cause the major and minor closure flaps to which they are connected to also flatten. The major closure flap having the lock tabs fully overlaps the other closure flaps. The base is then secured by inserting the locking tabs into the slots in the opposing side panel.

Unfortunately, it has been found in practice that if the pull down flaps are not accurately glued to the major closure flaps the locking tabs will not be precisely aligned with the receiving slots in the opposed side wall when the scoop is erected. Accordingly, in order to lock the tabs the scoop must be distorted somewhat. This distortion results in spaces between closure flaps and attendant therewith, undersirable leakage of detergent.

Accordingly, it is an object of the subject invention to provide a soap scoop having a new and improved base portion wherein when the scoop is erected the locking tabs will automatically be precisely aligned with their opposing receiving slots despite inaccuracies in gluing of the pull down flaps.

SUMMARY OF THE INVENTION

In accordance with the subject invention, a self-erecting soap scoop is constructed from a blank which is scored and cut into a plurality of panels and closure flaps. The blank includes a back panel which is hingedly connected to a first side panel. A front panel is hingedly connected on one side of the first side panel, and on its other side to a second side panel. A glue flap is hingedly connected to the other side of the second side panel. The subject blank further includes a plurality of closure flaps and pull down flaps for forming the automatically flattening base portion of the subject soap scoop. More particularly the blank further includes first and second minor closure flaps which are hingedly connected to the back panel and front panel respectively. A first major closure flap is hingedly connected to the first side panel, and includes an elongated locking tab having two inclined surfaces. One of said inclined surfaces terminates in a corner portion which forms a locking notch. A first tab receiving slot is disposed on the first side panel.

The subject blank further includes a second major closure flap which is hingedly connected to the second side panel. This second major closure flap has an elongated locking tab having two inclined surfaces, one of which terminates in a corner portion which forms a locking notch. A second tab receiving slot is disposed on second side panel.

The subject blank further includes a plurality of pull down flaps which are appropriately adhered to the closure flaps for providing the automatic base flattening feature.

In constructing the subject soap scoop the blank is folded along the fold lines connecting the respective panels and the glue flap is adhered to the back panel to form a tubular structure having four upstanding panels. In forming the base of the subject soap scoop, each of the pull down flaps is adhered to an appropriate closure flap. The closure flaps are then inwardly folded such that the major closure flaps which extend from opposing side walls, overlap the minor closure flaps and the pull down flaps. As the major closure flaps are flattened into position, the adjacent camming surfaces of each opposed locking tab contact each other and guide the tabs towards their respective receiving slots. When the corner portions of each major closure flap are engaged the scoop is squared and the locking tabs are automatically and precisely aligned with their respective receiving slots. When the major closure flaps are fully flattened the locking tabs are received in their respective receiving slots thus locking the base portion in position.

DETAILED DESCRIPTION OF THE PREFERRED EMBODIMENTS

Figure 1:
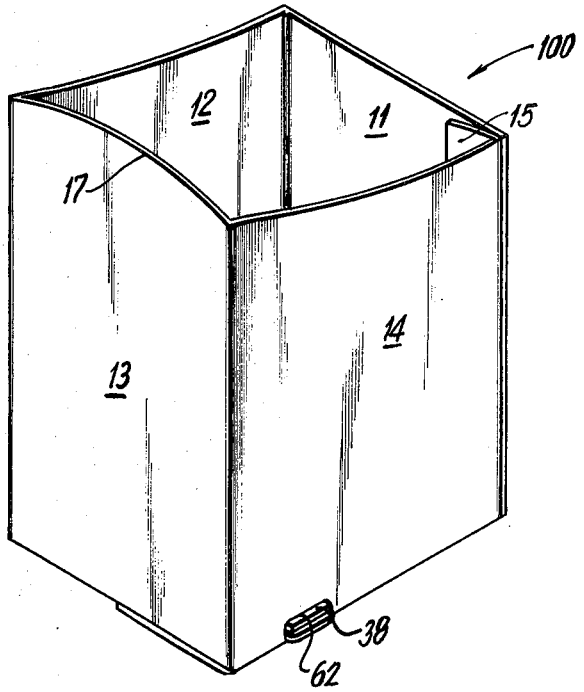
FIG. 1 is a perspective view of the soap scoop of the subject invention.
Figure 2:
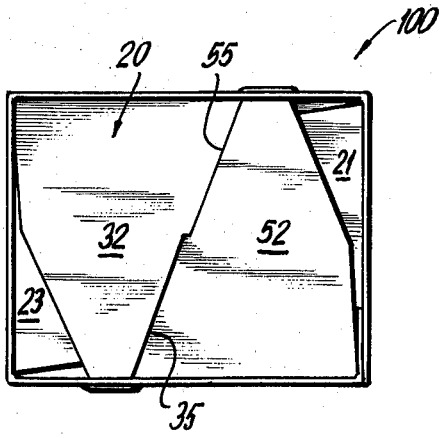
FIG. 2 is a top plan view of the soap scoop of the subject invention.
Figure 3:
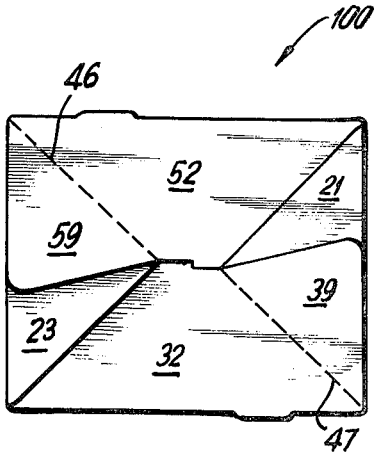
FIG. 3 is a bottom plan view of the soap scoop of the subject invention.

Referring to FIGS. 1–3 the soap scoop of the subject invention is a tubular container 100 having four upstanding walls including a front panel 13, a back panel 11, and a pair of opposed side panels 12 and 14. In order to facilitate the scooping of the produced laundry detergent, front panel 13 may be longer than back panel 11 and include a rounded top edge 17 thus forming a spout like member. Of course the provision of such a spout is not necessary to the subject invention. The soap scoop also includes a new and improved base portion 20 which will be described in detail below.

Figure 4:
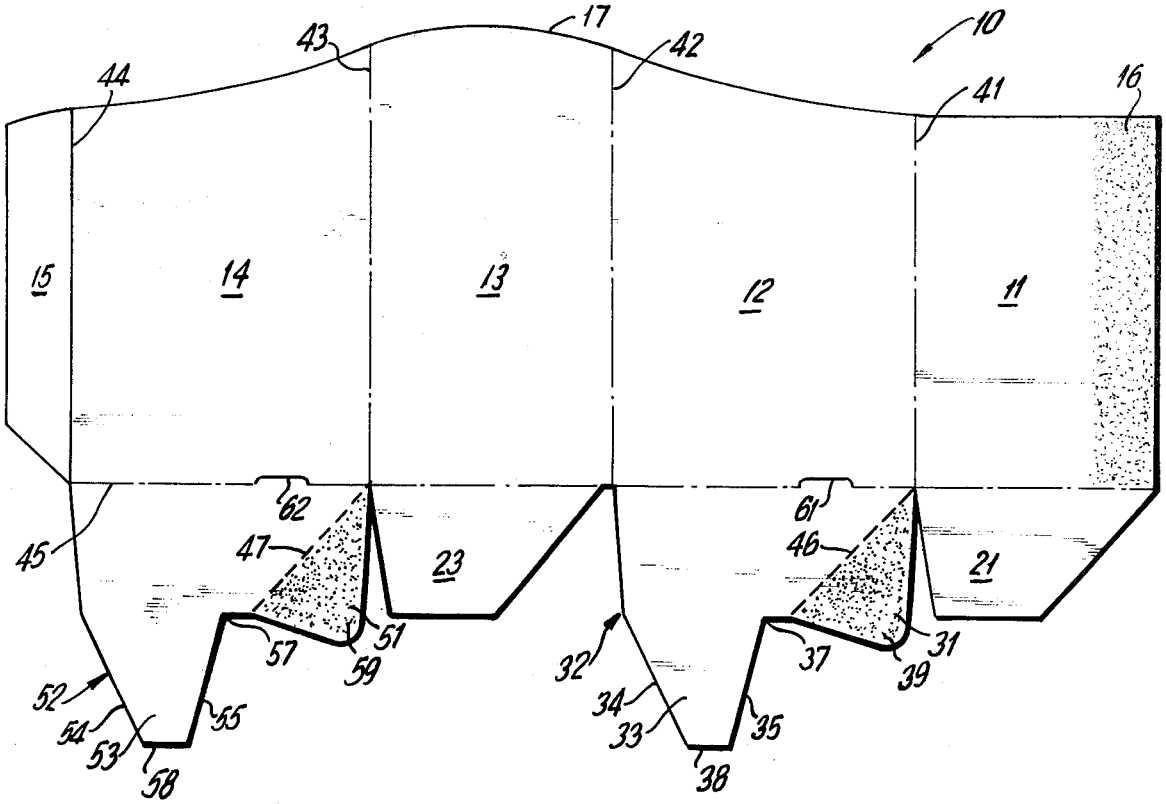
FIG. 4 is a plan view of the blank for forming the soap scoop of the subject invention.
Figure 5:
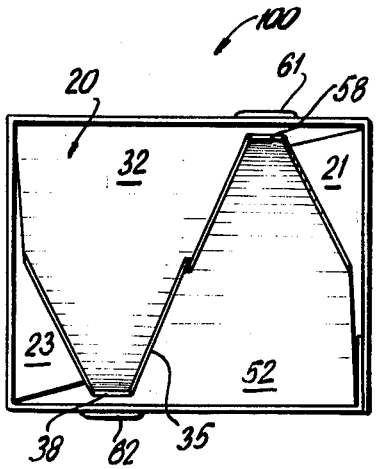
FIG. 5 is a top plan view of the soap scoop of the subject invention which has been squared, but before the lock tabs have been secured.

Referring to FIG. 4 the blank 10 for forming the soap scoop of the subject invention is scored and cut into a plurality of panels and flaps. In addition, it is preferable that both faces of the blank be printed or scored with appropriate indicia so that the scoop constructed therefrom may be used as a measuring cup. More particularly, blank 10 includes a back panel 11 which is hingedly connected along fold line 41 to a first side panel 12. A front panel 13 is hingedly connected on one side along fold line 42 to first side panel 12 and on its other side along fold line 43 to a second side panel 14. As indicated in FIG. 4 side panels 12 and 14 may increase in length as they approach front panel 13 disposed therebetween. As a result, front panel 13 is the largest of the panels and may have a rounded top edge 17. A glue flap 15 is hingedly connected to the other side of second side panel 14 along fold line 44. In order to construct the subject soap scoop it is preferable that a suitable adhesive 16 be applied to the free edge of back panel 11 so that glue flap 15 may be adhered thereto.

Blank 10 is further subdivided by a horizontal fold line 45 into a plurality of closure flaps for forming the base 20 (see FIG. 2) of the subject soap scoop, said flaps being hingedly connected to the above described panels. Base 20 is substantially rectangular in configuration and may typically be square. More particularly, blank 10 includes first and second minor closure flaps 21 and 23 which are hingedly connected to back panel 11 and front panel 13, respectively. Preferably, minor closure flaps 21 and 23 are substantially identical in configuration. A first major closure flap 32 is hingedly connected to first side panel 12 along fold line 45. closure flap 32 includes a first elongated locking tab 33 which is preferably trapezoidal in configuration and has two inclined surfaces 34 and 35. As will be described below surface 35 of tab 33 serves as a camming surface which extends from the free edge 38 of tab 33 to an intermediate portion of closure flap 32 and terminates in a corner portion which forms a first locking notch 37. In addition, a first tab receiving slot 61 is disposed along fold line 45 on first side panel.

A second major closure flap 52, which is substantially identical in configuration to first major closure flap 32 is hingedly connected to second side panel 14 along fold line 45. Closure flap 52 includes an elongated locking tab 53 preferably trapezoidal in configuration having inclined surfaces 54 and 55. As with surface 35 of first major closure flap 32, surface 55 of locking tab 53 serves as a camming surface which extends from free edge 58 of tab 53 to an intermediate portion of closure flap 52 and terminates in a second corner portion which forms a second locking notch 57. In addition, a second tab receiving slot 62 is disposed along fold line 45 on second side panel 14.

Blank 10 also includes pull down flaps 39 and 59 which are hingedly connected to major flaps 32 and 52 along fold lines 46, and 47 respectively.

It will be appreciated that the configurations of the major and minor closure flaps as well as that of the pull down flaps is not critical to the subject invention, automatic flattening bottoms being known in the art. In addition, it is not critical whether the pull down flaps are connected to the major closure flaps or the minor closure flaps.

Figure 6:
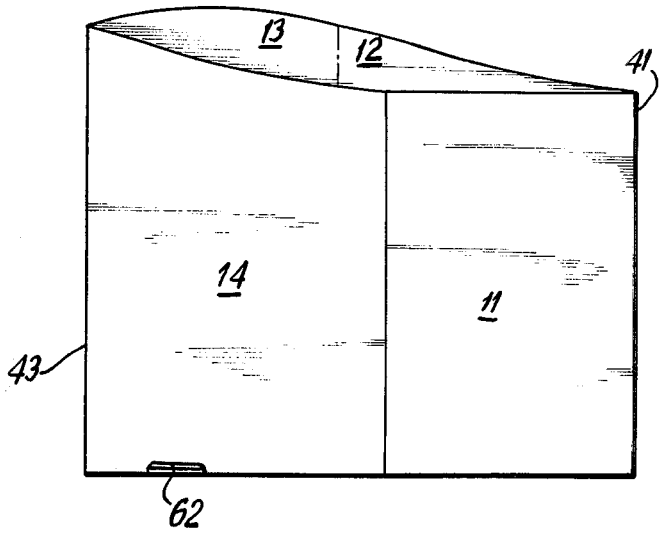
FIG. 6 is an elevational view of the soap scoop of the subject invention which has been flattened for packing within a box of detergent.

As illustrated in FIGS. 1–5 the subject soap scoop is constructed by folding blank 10 along fold lines 41–46 and adhering glue flap 15 to the free edge of back panel 11 to form tubular structure 100. In addition, closure flaps 21, 23, 32, 52 are folded along fold line 45, and pull down flaps 39 and 59 which contain adhesive 31 and end 51 are adhered to minor closure flaps 21 and 23 respectively. For the purpose of packing into detergent boxes the subject scoop may be flattened along fold lines 41 and 43 as illustrated in FIG. 6. It will be appreciated that closure flaps 21, 23, 32 and 52 are upwardly folded along fold line 45, and diagonal fold lines 46 and 47 and lie within the scoop illustrated in FIG. 6.

Once the consumer has removed the flattened scoop from the detergent box the scoop may be easily erected. More particularly, referring to FIG. 5, the scoop is squared causing the closure flaps to flatten into base portion 20. As is apparent with the particular closure flap-pulldown flap construction illustrated in FIG. 5, major closure flaps 32 and 52, each of which extends from an opposite wall of the scoop, overlap minor closure flaps 21 and 23 and pull down flaps 39 and 59.

Locking tabs 33 and 53 emanate from opposed side walls of the scoop and are in close lateral adjacency as the closure flaps are flattened. As a result the camming surfaces of each locking tab, i.e., 35 and 55, respectively, engage each other and guide each tab to its opposed receiving slot, 62 and 61, respectively (see FIG. 5). The particular configuration of surfaces 33 and 55 and the camming action and cooperation therebetween cause the scoop to be precisely squared, with the locking tabs 33 and 53 being automatically and precisely aligned with their respective opposed receiving slots 62 and 61. When closure flaps 32 and 52 are completely flattened (see FIG. 2), lock tabs 33 and 53 are received in slots 62 and 61, and locking notches 37 and 57 engage each other thus locking the closure flaps in position. In the locked position each minor closure flap 21 and 23 is disposed between both major closure flaps 32 and 52.

In summary, the subject invention provides a new and improved self-erecting soap scoop and blank for forming same. More particularly, the subject soap scoop has a new and improved base portion by which the locking tabs of the base closure flaps automatically align with their respective opposing receiving slots. Thus, when the tabs are secured, the scoop is perfectly squared and there is no leakage of detergent powder.

While the preferred embodiment of the subject invention has been described and illustrated, it would be obvious that various changes and modifications can be made therein without departing from the spirit of the invention which should be limited only by the scope of the appended claims.

What is claimed is:

1. A blank for forming a self erecting soap scoop of generally rectangular configuration and tubular shape and having an automatically flattening base portion comprising:

a substantially rectangular sheet of paperboard, said sheet having opposed vertical lateral edges and opposed horizontal top and bottom edges;

four vertically spaced parallel fold lines intermediate the lateral edges thereof defining first and second sidewalls, a front panel, a back panel, and a manufacturer's glue flap positioned at one lateral edge thereof;

said sidewalls, front panel and back panel having edn closure flaps hingedly connected to the bottom edges thereof along said bottom horizontal edges for forming said base portion, each of said sidewalls including a tab receiving slot along its bottom horizontal edge;

a first elongated locking tab hingedly connected to the first side panel closure flap, said locking tab having a camming surface which extends from the free edge of said first locking tab and terminates in a first locking notch;

a second elongated locking tab hingedly connected to the second side panel closure flap, said second locking tab having a camming surface which extends from the free edge of said second locking tab and terminates in a second locking notch;

whereby when said soap scoop is erected the locking tabs oppose each other and are in close lateral adjacency such that the camming surfaces of each engage and precisely square the scoop and guide the first locking tab to the second tab receiving slot opposed thereto, and the second locking tab to the first tab receiving slot.

2. A blank for forming a self erecting soap scoop of generally rectangular configuration and tubular shape and having an automatically flattening base portion comprising:

a substantially rectangular sheet of paperboard, said sheet having opposed vertical lateral edges and opposed horizontal top and bottom edges, said paperboard including printed indicia for measuring the contents of the scoop when it is erected.

four vertically spaced parallel fold lines intermediate the lateral edges thereof defining first and second sidewalls, a front panel, a back panel, and a manufacturer's glue flap positioned at one lateral edge thereof, said front panel being longer than said back panel and having a rounded top edge;

said sidewalls, front panel and back panel having end closure flaps hingedly connected to the bottom edges thereof along said bottom horizontal edges for forming said base portion, each of said sidewalls including a tab receiving slot along its bottom horizontal edge;

a first elongated locking tab hingedly connected to the first side panel closure flap, said locking tab being substantially trapezoidal in configuration and having a pair of inclined surfaces, one of said surfaces being a camming surface which extends from the free edge of said first locking tab and terminates in a first locking notch;

a second elongated locking tab hingedly connected to the closure flap of the second side panel, said second locking tab being substantially trapezoidal in configuration and having a pair of inclined surfaces one of said surfaces being a camming surface which extends from the free edge of said second locking tab and terminates in a second locking notch;

whereby when said soap scoop is erected the locking tabs oppose each other and are in close lateral adjacency such that the camming surfaces of each engage and precisely oppose the scoop of each and guide the first locking tab to the second tab receiving slot opposed thereto, and the second locking tab to the first tab receiving slot.

3. A self erecting soap scoop of tubular structure having opposed front and back panels, and first and second opposed side panels, said soap scoop furter having an improved automatically flattening base portion including a plurality of closure flaps and pull down flaps, said closure flaps and pull down flaps being hingedly connected to said front and back panels and said first and second opposed side panels on the bottom edges thereof, the improvement comprising:

a first elongated locking tab extending from the closure flap hingedly connected to said first side panel, said first locking tab having a camming surface extending from the free end of said first locking tab and terminating in a first locking notch; a second elongated locking tab extending from the closure flap hingedly connected to said second side panel, said second locking tab having a camming surface extending from the free end of said second locking tab and terminating in a second locking notch; said first and second locking tabs being opposed to one another and in close lateral adjacency to one another such that when said base portion is flattened the camming surfaces of each locking tab engage each other and precisely square the scoop and guide the locking tabs to opposed tab receiving slots, said tab receiving slots being disposed on the bottom edges of said first and second side panels in diagonally opposed relationship to one another, said base portion being in a locked position when the locking tabs are received in their respective tab receiving slots and the locking notches of said locking tabs engage each other.

4. A self erecting soap scoop of tubular structure having opposed front and back panels, and first and second opposed side panels, said scoop including printed indicia on the outside thereof for measuring the contents of the scoop, said front panel being longer than said back panel, and having a rounded top edge, said soap scoop further having an improved base portion including a plurality of closure flaps and pull down flaps, said closure flaps and pull down flaps being hingedly connected to said front and back panels and said first and second opposed side panels, the imrpovement comprising:

a first elongated locking tab extending from the closure flap hingedly connected to said first side panel, said first locking tab being substantially trapezoidal in configuration and having two inclined surfaces, one of said surfaces being a camming surface extending from the free end of said first locking tab and terminating in a first locking notch; a second elongated locking tab extending from the closure flap hingedly connected to said second side panel, said second locking tab being substantially trapezoidal in configuration and having two inclined surfaces, one of said surfaces being a camming surface extending from the free end of said second locking tab and terminating in a second locking notch; said first and second locking tabs being opposed to one another and in close lateral adjacency to one another such that when said base portion is flattened the camming surfaces of each locking tab engage each other precisely square the scoop and guide the locking tabs to opposed tab receiving slots, said tab receiving slots being disposed on the bottom edges of said first and second side panels in diagonally opposed relationship to one another, said base portion being in a locked position when the locking tabs are received in their respective tab receiving slots and the locking notches of said locking tabs engage each other.

* * * * *